US012408811B2

(12) United States Patent
Kim et al.

(10) Patent No.: US 12,408,811 B2
(45) Date of Patent: Sep. 9, 2025

(54) PUMP AND DISHWASHER COMPRISING THE SAME

(71) Applicant: LG Electronics Inc., Seoul (KR)

(72) Inventors: Youngsoo Kim, Seoul (KR); Jinhyouk Shin, Seoul (KR); Minseong Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 135 days.

(21) Appl. No.: 17/126,389

(22) Filed: Dec. 18, 2020

(65) Prior Publication Data

US 2021/0127941 A1 May 6, 2021

Related U.S. Application Data

(63) Continuation of application No. 15/926,036, filed on Mar. 20, 2018, now Pat. No. 10,898,053.

(30) Foreign Application Priority Data

Mar. 20, 2017 (KR) ..... 10-2017-0034510

(51) Int. Cl.

| | |
|---|---|
| ***A47L 15/42*** | (2006.01) |
| ***A47L 15/14*** | (2006.01) |
| ***F04D 29/58*** | (2006.01) |

(52) U.S. Cl.

CPC ..... *A47L 15/4234* (2013.01); *A47L 15/14* (2013.01); *A47L 15/4221* (2013.01); (Continued)

(58) Field of Classification Search

CPC ..... A47L 15/4225; A47L 15/4234; A47L 15/00–508

See application file for complete search history.

(56) References Cited

U.S. PATENT DOCUMENTS 3,463,173 A * 8/1969 Goldman ..... B01L 13/02 134/152

2006/0060225 A1 3/2006 Han et al.

(Continued)

FOREIGN PATENT DOCUMENTS

DE 202015002175 6/2015
EP 2818091 12/2014

(Continued)

OTHER PUBLICATIONS

KR Office Action in Korean Appln. No. 10-2017-0034510, dated Apr. 26, 2021, 18 pages (with English translation).

(Continued)

*Primary Examiner* — Spencer E. Bell

(74) *Attorney, Agent, or Firm* — Fish & Richardson P.C.

(57) ABSTRACT

A pump includes a housing, a water inlet pipe coupled to the housing and configured to receive washing water, a water outlet pipe coupled to the housing and configured to discharge washing water, an impeller located in the housing and configured to cause washing water to be transferred from the water inlet pipe to the water outlet pipe, a heater that is coupled to the housing, that is configured to heat washing water in the housing, and that is configured to generate steam based on heating washing water, and a steam discharge pipe coupled to the water outlet pipe and configured to discharge steam generated by the heater.

18 Claims, 10 Drawing Sheets

(52) U.S. Cl.
CPC ..... *A47L 15/4223* (2013.01); *A47L 15/4225* (2013.01); *A47L 15/4285* (2013.01); *F04D 29/588* (2013.01)

(56) References Cited

U.S. PATENT DOCUMENTS

| | | | | |
|---|---|---|---|---|
| 2006/0180184 | A1 | 8/2006 | Jeong | |
| 2009/0235957 | A1 | 9/2009 | Kim | |
| 2010/0206332 | A1 | 8/2010 | Kim et al. | |
| 2012/0279536 | A1* | 11/2012 | Adams | A47L 15/22 134/56 D |

FOREIGN PATENT DOCUMENTS

| | | |
|---|---|---|
| KR | 10-2009-0060636 | 6/2009 |
| KR | 20120116326 | 10/2012 |
| KR | 10-2017-0010550 | 2/2017 |
| KR | 20170016180 | 2/2017 |
| WO | WO2016028049 | 2/2016 |
| WO | WO2017022974 | 2/2017 |
| WO | WO2018174590 | 9/2018 |

OTHER PUBLICATIONS

AU Office Action in Australian Appln. No. 2020200194, dated Feb. 11, 2021, 4 pages.
IN Office Action in Indian Appln. No. 201917042407, dated Feb. 5, 2021, 6 pages (with English translation).
U.S. Office Action in U.S. Appl. No. 15/926,036, dated Jun. 2, 2020, 15 pages.
Office Action in Korean Appln. No. 10-2022-0013084, dated Apr. 19, 2022, 10 pages (with English translation).
Extended European Search Report in European Appln. No. 23185202.1, mailed on Nov. 22, 2023, 12 pages.

* cited by examiner

PUMP AND DISHWASHER COMPRISING THE SAME

CROSS-REFERENCE TO RELATED APPLICATION

This application is a continuation of U.S. application Ser. No. 15/926,036, filed on Mar. 20, 2018, which claims the priority benefit of Korean Patent Application No. 10-2017-0034510, filed on Mar. 20, 2017, in the Korean Intellectual Property Office, the disclosures of which are incorporated herein by reference in their entirety.

FIELD

The present disclosure relates to a pump and a dishwasher including the same, and more particularly, to a pump that transmits washing water and that generates steam, and to a dishwasher including the pump.

BACKGROUND

A dishwasher is an appliance that can remove foreign matter on tableware, for example, by spraying washing water to the tableware. The dishwasher may include a tub that defines a washing space, a rack that is located in the tub and that accommodates tableware, a spraying arm that sprays washing water to the rack, a sump that stores washing water, and a pump that supplies washing water stored in the sump to the spraying arm.

In some examples, the dishwasher performs cleaning by using heated washing water, or performs cleaning or sterilization of tableware by supplying steam to the tableware. For example, dishwashers may generate hot water or steam by heating washing water stored in the sump through a heater provided inside the sump. In some cases where the heater is exposed to the inside of the sump and contacts washing water to heat washing water, the water level inside the sump may be controlled for the heater not to be exposed to prevent overheating of the heater. In some cases where heat transmission occurs when the heater contacts washing water, foreign matter may adhere to a surface of the heater in which a heat exchange efficiency may decrease and the surface of the heater may be corroded, which decreases the durability.

In some examples, a dishwasher may include a heater in a pump. In this case, the heater in the pump heats washing water to generate hot water or steam. In some cases, the performance of the pump may be deteriorated as air can enter a passage for discharging steam, or the steam performance may be deteriorated as steam can discharge through a passage for flow of washing water.

SUMMARY

The present disclosure provides a pump and a dishwasher that can generate steam and smoothly discharge steam without deteriorating the performance of the pump.

According to one aspect of the subject matter described in this application, a pump includes a housing, a water inlet pipe coupled to the housing and configured to receive washing water, a water outlet pipe coupled to the housing and configured to discharge washing water, an impeller located in the housing and configured to cause washing water to be transferred from the water inlet pipe to the water outlet pipe, a heater that is coupled to the housing, that is configured to heat washing water in the housing, and that is configured to generate steam based on heating washing water, and a steam discharge pipe coupled to the water outlet pipe and configured to discharge steam generated by the heater.

Implementations according to this aspect may include one or more of the following features. For example, a cross-sectional area of the steam discharge pipe is less than a cross-sectional area of the water outlet pipe. The water outlet pipe may extend in a horizontal direction, and the steam discharge pipe may extend from the water outlet pipe in a direction that is inclined upward with respect to the horizontal direction.

In some implementations, the water outlet pipe may extend in a first direction, and the steam discharge pipe extends from the water outlet pipe in a second direction that is orthogonal to the first direction. The housing may define an internal space at an inside of the housing, and the pump further includes a partition wall that divides the internal space into a positive pressure chamber that is configured to accommodate the impeller and that is coupled to the water outlet pipe, and a negative pressure chamber that is coupled to water inlet pipe.

In some implementations, the water outlet pipe may include a stepped portion that protrudes from an inner surface of the water outlet pipe in which the stepped portion is located at a coupling region connected to the steam discharge pipe. In some cases, the water outlet pipe includes a first portion that extends from the coupling region toward the impeller, and a second portion that extends from the coupling region in a direction away from the impeller, where the stepped portion protrudes from an inner surface of the first portion of the water outlet pipe. The stepped portion may be located at an entrance of the steam discharge pipe. The pump may further include a check valve configured to close the water inlet pipe to restrict discharge of steam through the water inlet pipe.

According to another aspect, a dishwasher includes a tub, a spray arm configured to spray washing water into the tub, a steam supply unit configured to discharge steam into the tub, a sump configured to store washing water, and a pump that is configured to supply washing water stored in the sump to the spray arm, that is configured to generate steam, and that is configured to supply steam to the steam supply unit. The pump defines a negative pressure chamber that is coupled to the sump, and a positive pressure chamber that is coupled to the spray arm and the steam supply unit.

Implementations according to this aspect may include one or more of the following features. For example, the pump includes a partition wall that divides an internal space of the pump into the negative pressure chamber and the positive pressure chamber. In some examples, the pump includes a water outlet pipe coupled to the positive pressure chamber and configured to discharge washing water to the spray arm, and a steam discharge pipe coupled to the water outlet pipe and configured to discharge steam to the steam supply unit.

In some implementations, a cross-sectional area of the steam discharge pipe may be less than a cross-sectional area of the water outlet pipe. In some examples, the water outlet pipe extends in a horizontal direction, and the steam discharge pipe extends from the water outlet pipe in a direction that is inclined upward with respect to the horizontal direction. In some examples, the water outlet pipe extends in a first direction, and the steam discharge pipe extends from the water outlet pipe in a second direction that is orthogonal to the first direction.

In some implementations, the water outlet pipe includes a coupling region connected to the steam discharge pipe, a first portion that extends from the coupling region toward the positive pressure chamber, and a second portion that extends from the coupling region in a direction away from the positive pressure chamber, wherein a cross-sectional area of the first portion is less than a cross-sectional area of the second portion.

In some implementations, the pump includes a water inlet pipe coupled to the negative pressure chamber and configured to receive washing water from the sump, and a check valve configured to close the water inlet pipe to restrict discharge of steam through the water inlet pipe. The water outlet pipe may include a stepped portion that protrudes from an inner surface of the water outlet pipe, the stepped portion being located at a coupling region connected to the steam discharge pipe.

In some implementations, the check valve includes a valve body that is configured to rotate toward the negative pressure chamber based on supply of washing water through the water inlet pipe. In some examples, the valve body defines a cut portion that is spaced apart from an inner surface of the water inlet pipe and that allows washing water to discharge from the pump to the sump in a state in which the check valve closes the water inlet pipe.

BRIEF DESCRIPTION OF THE DRAWINGS

The objects, features and advantages of the present disclosure will be more apparent from the following detailed description in conjunction with the accompanying drawings.

DETAILED DESCRIPTION

Exemplary implementations of the present disclosure are described with reference to the accompanying drawings in detail. The same reference numbers are used throughout the drawings to refer to the same or like parts. Detailed descriptions of well-known functions and structures incorporated herein may be omitted to avoid obscuring the subject matter of the present disclosure.

Hereinafter, the present disclosure will be described with reference to the drawings for explaining a pump and a dishwasher including the same according to implementations of the present disclosure.

Figure 1:
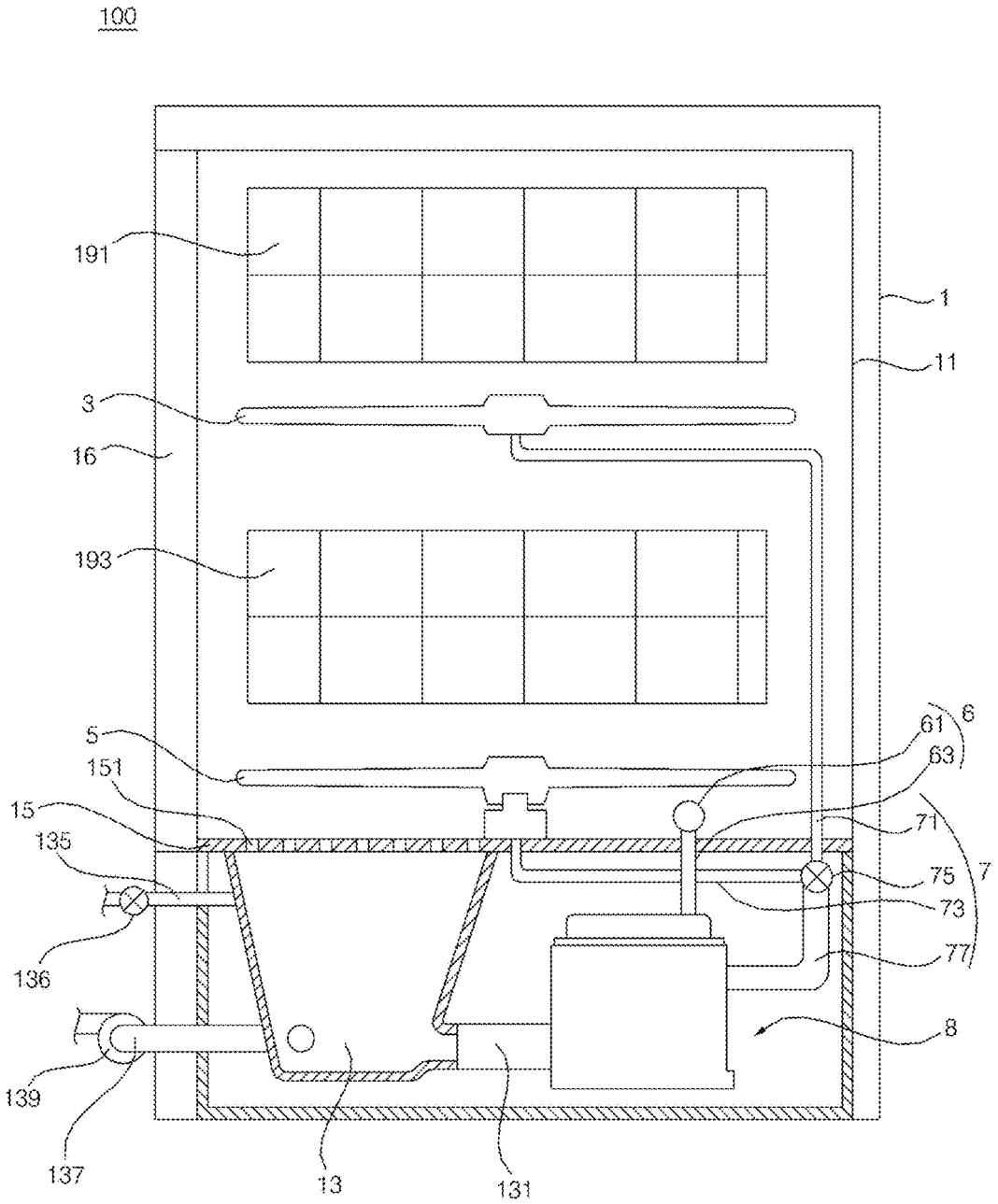
FIG. 1 is a schematic cross-sectional view showing an example dishwasher.

FIG. 1 illustrates an example dishwasher.

A dishwasher 100 may include a cabinet 1 that defines an outer appearance, a tub 11 located inside the cabinet 1 and configured to accommodate a dishware, a plurality of spraying arms 3 and 5 configured to spray washing water into the tub 11, a steam supply unit 6 configured to discharge steam into the tub 11, a sump 13 configured to store washing water, and a pump 8 that is configured to supply the washing water stored in the sump 13 to the plurality of spraying arms 3 and 5 and that is configured to generate steam and supply steam to the steam supply unit 6.

A plurality of racks 191 and 193 for storing dishware may be located in the tub 11. The plurality of racks 191 and 193 may include an upper rack 191 provided in an upper area of the tub 11 and a lower rack 193 provided in a lower area of the tub 11.

The tub 11 may be opened and closed by a door 16 provided on one side of the cabinet. A user may take out the plurality of racks 191 and 193 from the tub 11 after opening the door 16.

For example, the plurality of spraying arms may include an upper spraying arm 3 for spraying washing water to the upper rack 191 and a lower spraying arm 5 for spraying washing water to the lower rack 193. The washing water sprayed from the plurality of spraying arms 3 and 5 may be collected into the sump 13.

The sump 13 may be provided in a lower portion of the tub 11 to store washing water. A sump cover 15 may be disposed in an upper side of the sump 13. The sump cover 15 may be provided with a recovery hole 151 so that washing water in the tub 11 can pass through the recovery hole 151 and flow into the sump 13.

The sump 13 may be coupled to an external water source through a water supply channel 135. The water supply channel 135 may be opened and closed by a water supply valve 136. The washing water stored in the sump 13 may be discharged to the outside of the cabinet 1 through a drainage pipe 137 and a drain pump 139.

The washing water stored in the sump 13 may be supplied to the plurality of spraying arms 3 and 5 through the pump 8 and a washing water supply unit 7. The washing water supply unit 7 may include a main connection pipe 77 coupled to the pump 8, an upper portion connection pipe 71 connecting the main connection pipe 77 and the upper spraying arm 3, and a lower portion connection pipe 73 connecting the main connection pipe 77 and the lower spraying arm 5.

The upper portion connection pipe 71 and the lower portion connection pipe 73 may be branched from the main connection pipe 77, and a switching valve 75 for controlling the opening and closing of the upper portion connection pipe and/or the lower portion connection pipe 73 may be provided in a branch point of the upper portion connection pipe 71 and the lower portion connection pipe 73.

The sump 13 may be coupled to the pump 8 and a supply pipe 131. The supply pipe 131 may guide the washing water in the sump 13 to the pump 8.

The steam supply unit 6 may discharge steam into the tub 11. The steam discharged from the steam supply unit 6 may rise and act on the tableware housed in the plurality of racks 191 and 193. The steam supply unit 6 may include a steam nozzle 61 disposed in the tub 11 to discharge steam and a steam supply pipe 63 connecting the steam nozzle 61 and the pump 8.

The pump 8 may transmit the washing water stored in the sump 13 to the washing water supply unit 7. The pump 8 may heat the washing water transmitted to the washing water supply unit 7. The pump 8 may suck the washing water stored in the sump 13 and supply to the plurality of spraying arms 3 and 5 through the washing water supply unit 7.

The pump 8 may generate steam and supply it to the steam supply unit 6. The pump 8 may generate steam by heating the washing water stored in the pump 8 without transmitting the washing water. The steam generated in the pump 8 may be discharged into the tub 11 through the steam supply unit 6.

The pump 8 will be described in detail with reference to FIG. 2 and following drawings.

Figure 2:
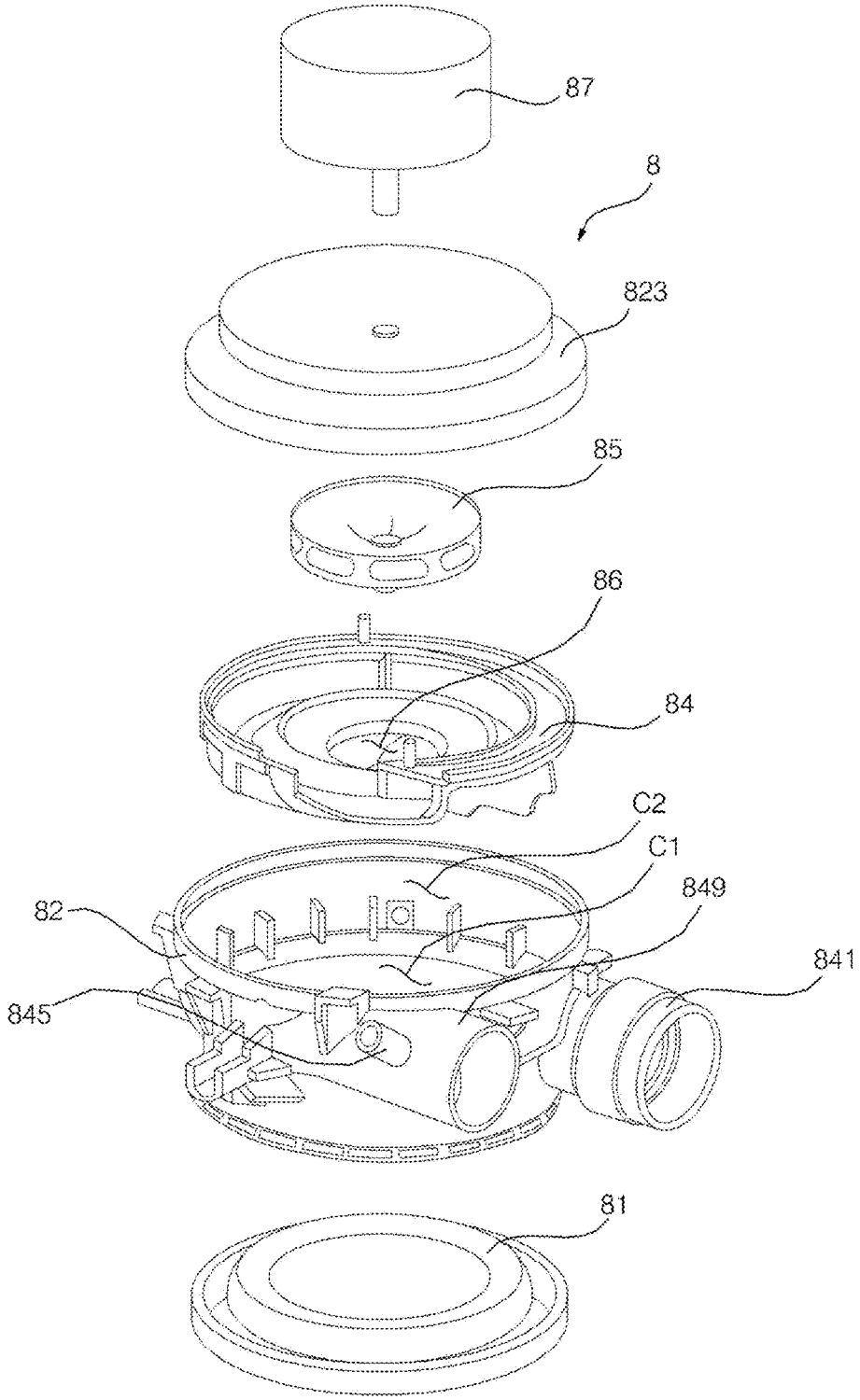
FIG. 2 is an exploded perspective view showing an example pump.
Figure 3:
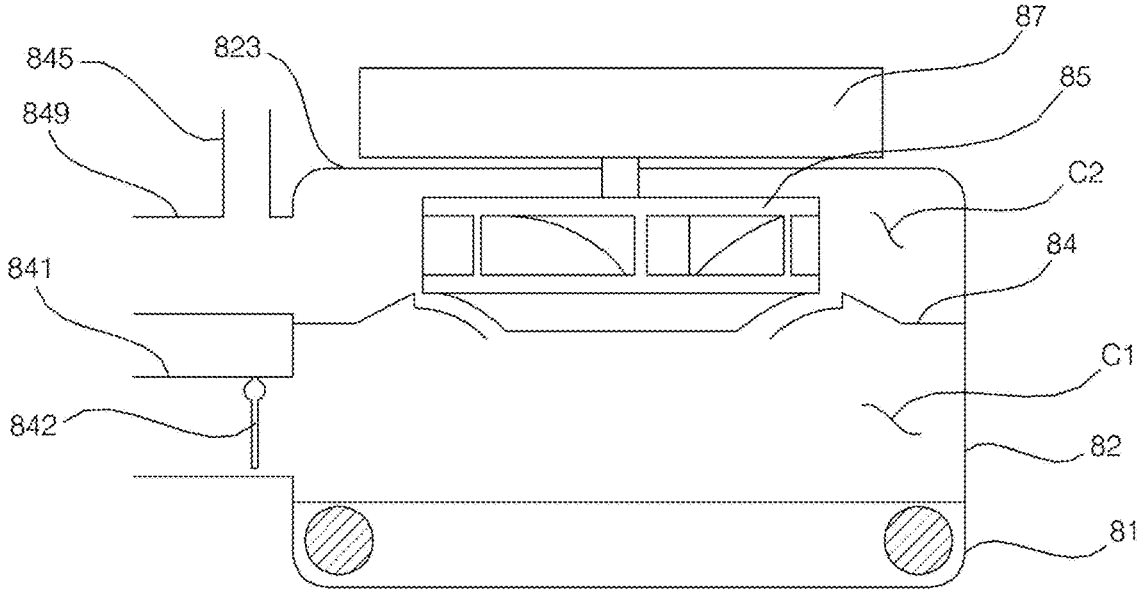
FIG. 3 is a schematic cross-sectional view showing an example pump.

FIG. 2 is an exploded perspective view showing an example pump, and FIG. 3 is a schematic cross-sectional view of an example pump.

For example, the pump 8 may include a housing 82 having a cylindrical shape which is fixed inside the cabinet 1, a washing water inlet pipe 841 which is coupled to the housing and into which the washing water flows, a washing water outlet pipe 849 which is coupled to the housing 82 and discharges the washing water, an impeller 85 which is disposed inside the housing 82 to transfer the washing water from the washing water inlet pipe 841 to the washing water outlet pipe 849, a heater 81 coupled to the housing 82 and heats the washing water inside the housing 82 to generate steam, and a steam discharge pipe 845 which is coupled to the washing water outlet pipe 849 and discharges the steam generated by the heater 81.

The housing 82 may be formed in a cylindrical shape having open top and bottom. A housing cover 823 may be coupled to the upper end of the housing 82, and the heater may be coupled to the lower end thereof. The housing cover 823 may cover the upper portion of the housing 82, and the housing cover 823 may be provided with a motor 87 for generating a rotational force to rotate the impeller 85.

A partition wall 84 may be disposed inside the housing 82. The partition wall 84 may divide an internal space of the housing 82 into upper and lower portions. The partition wall 84 may form a negative pressure chamber C1 and a positive pressure chamber C2 inside the housing 82. The negative pressure chamber C1 may be a place where a negative pressure is generated by the rotation of the impeller 85 and the positive pressure chamber C2 may be a place where a positive pressure is generated by the rotation of the impeller 85. The negative pressure chamber C1 may be coupled to the sump 13 through the supply pipe 131 and the washing water inlet pipe 841. The positive pressure chamber C2 may be coupled to the plurality of spraying arms 3, 5 through the washing water outlet pipe 849 and the washing water supply unit 7.

In some implementations, the partition wall 84 may define a communication hole 86 configured to communicate with the negative pressure chamber C1 and the positive pressure chamber C2. The surface of the partition wall 84 in the positive pressure chamber C2 side may be formed in a volute.

The impeller 85 may be rotated by the motor 87 to discharge the water in the housing 82 to the outside. The impeller 85 may be rotatably disposed in the positive pressure chamber C2. The impeller 85 may transfer the washing water introduced from the negative pressure chamber C1 into the positive pressure chamber C2 through the communication hole 86 to the washing water outlet pipe 849.

The heater 81 may be coupled to the lower end of the housing 82 to form a bottom surface of the housing 82. The heater 81 may heat the washing water flowing inside the housing 82 when the impeller 85 rotates. The heater 81 may generate steam by heating the washing water in the housing 82 when the impeller 85 stops.

The washing water inlet pipe 841 may be coupled to the negative pressure chamber C1 side of the housing 82. The washing water inlet pipe 841 may be coupled to the supply pipe 131 and the washing water of the sump 13 may flow into the negative pressure chamber C1. The washing water inlet pipe 841 may be disposed to protrude outward from the lower side wall of the housing 82. The washing water inlet pipe 841 may be arranged in such a manner that a pipe direction is horizontal, so that the washing water flows in the horizontal direction. A check valve 842 for opening and closing the washing water inlet pipe 841 is disposed in the washing water inlet pipe 841. Details of the check valve 842 will be described later with reference to FIG. 8 to FIG. 10.

The washing water outlet pipe 849 may be coupled to the positive pressure chamber C2 side of the housing 82. The washing water outlet pipe 849 may be coupled to the main connection pipe 77 of the washing water supply unit 7 so that the washing water of the positive pressure chamber C2 flows out to the main connection pipe 77. The washing water outlet pipe 849 may be arranged to protrude outward from the upper side wall of the housing 82. The washing water outlet pipe 849 may be arranged in such a manner that a pipe direction is horizontal, so that the washing water flows in the horizontal direction.

The steam discharge pipe 845 is coupled to the positive pressure chamber C2 side of the housing 82. The steam discharge pipe 845 may be disposed in various locations of the housing 82 so as to connect the positive pressure chamber C2 of the housing 82 and the steam supply unit 6. In the present implementation, the steam discharge pipe 845 is coupled to the washing water outlet pipe 849. The steam discharge pipe 845 may discharge steam generated in the housing 82 by the heater 81 to the steam supply unit 6. The steam supply unit 6 may be coupled to the positive pressure chamber C2 through the steam discharge pipe 845.

Figure 4:
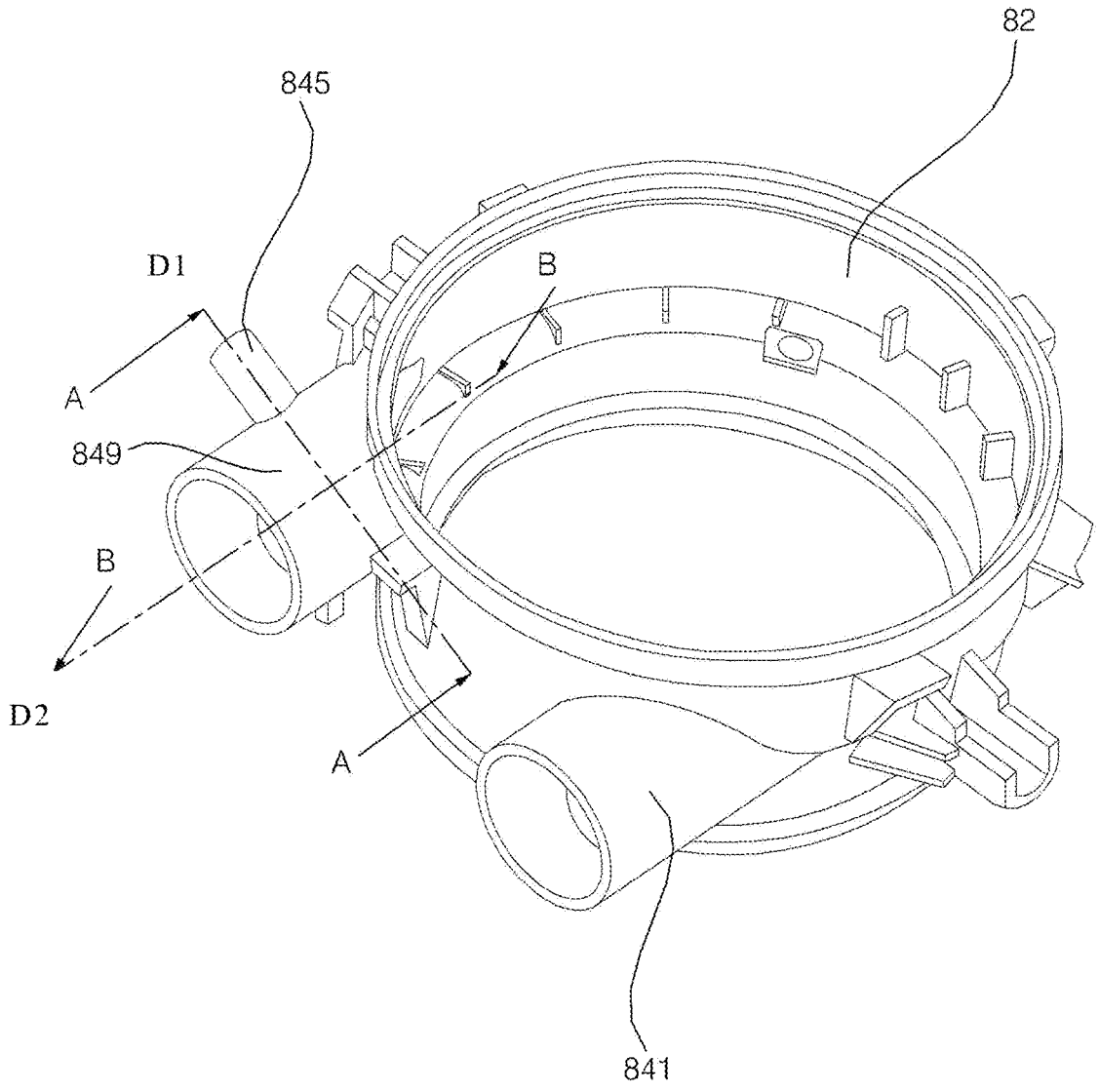
FIG. 4 is a perspective view showing a portion of an example pump.
Figure 5:
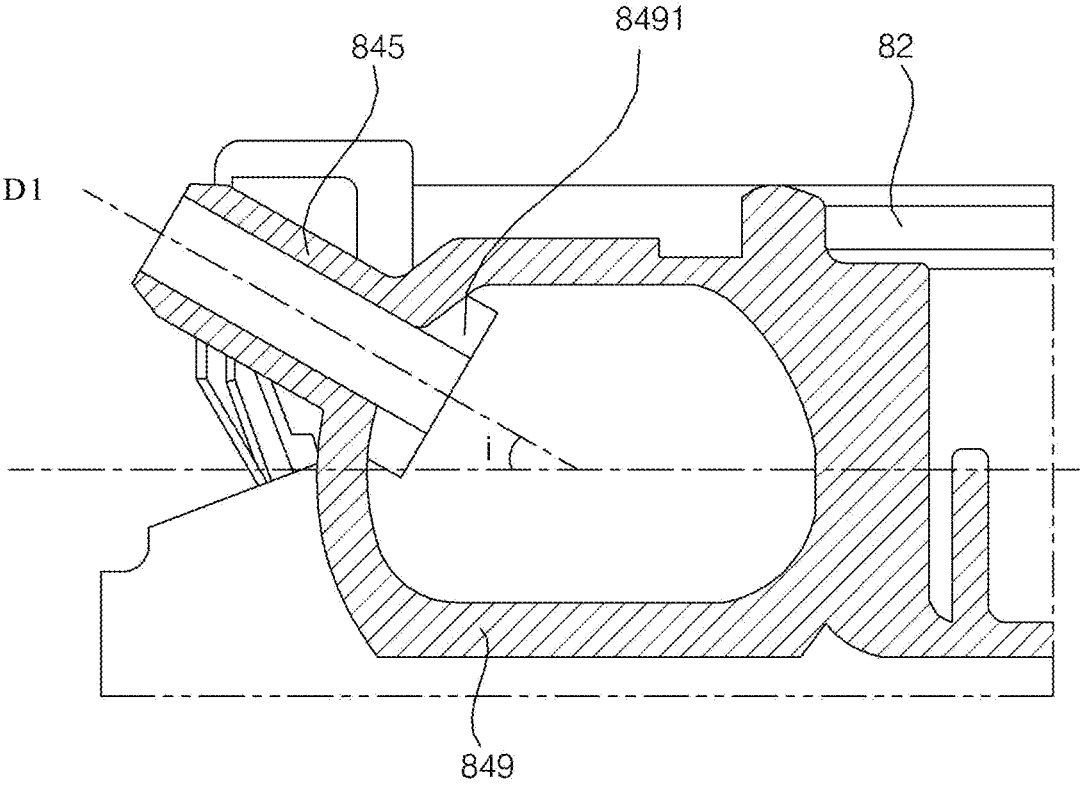
FIG. 5 is a cross-sectional view taken along line A-A of FIG. 4.
Figure 6:
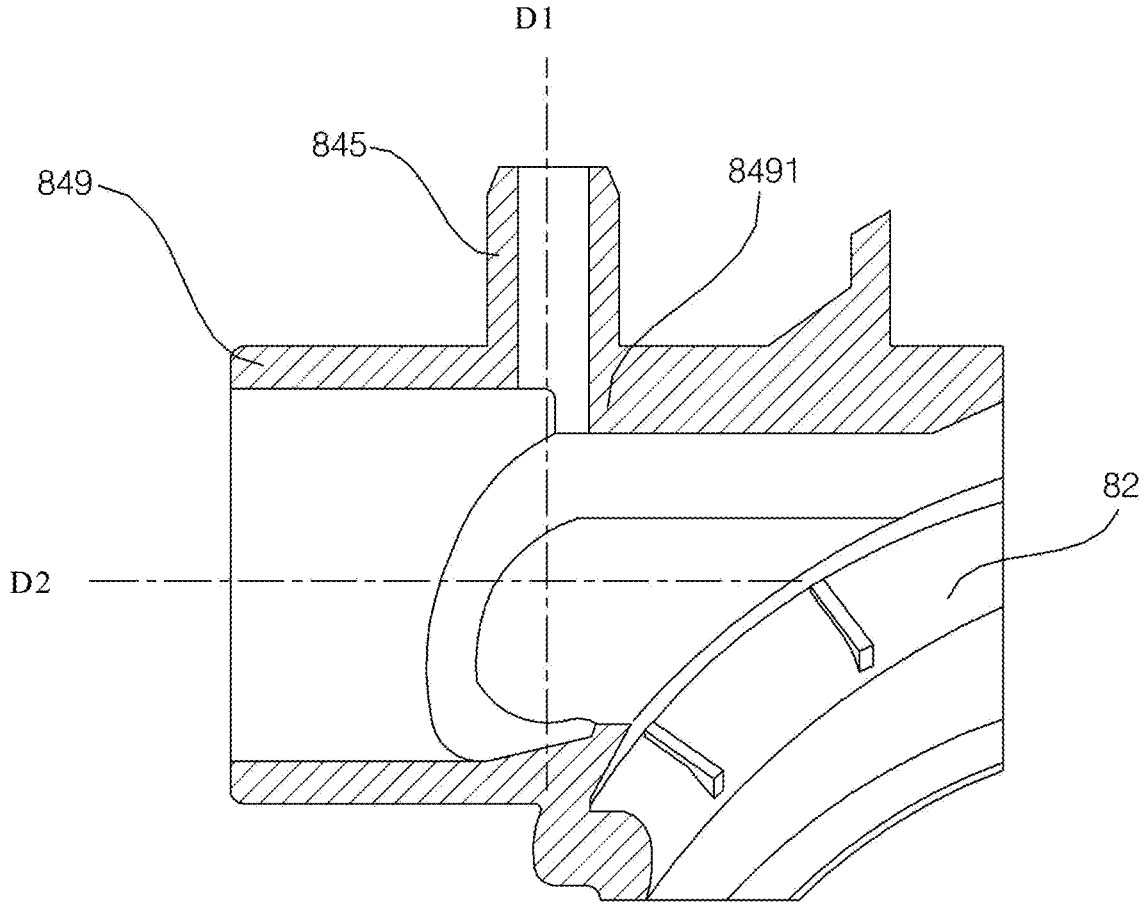
FIG. 6 is a cross-sectional view taken along line B-B in FIG. 4.
Figure 7A:
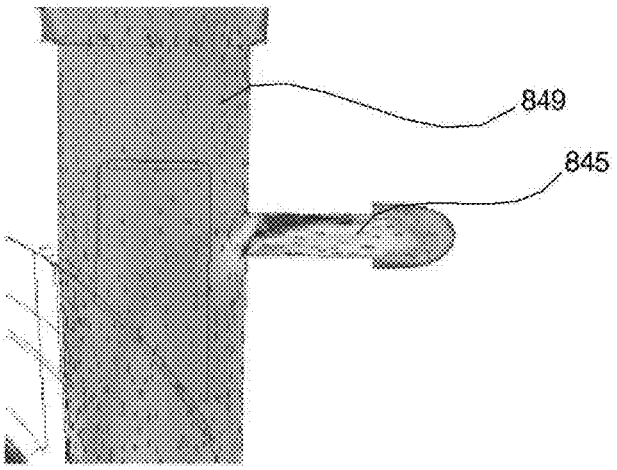
FIGS. 7A and 7B illustrate example experimental results of washing water outflow of an example pump.
Figure 7B:
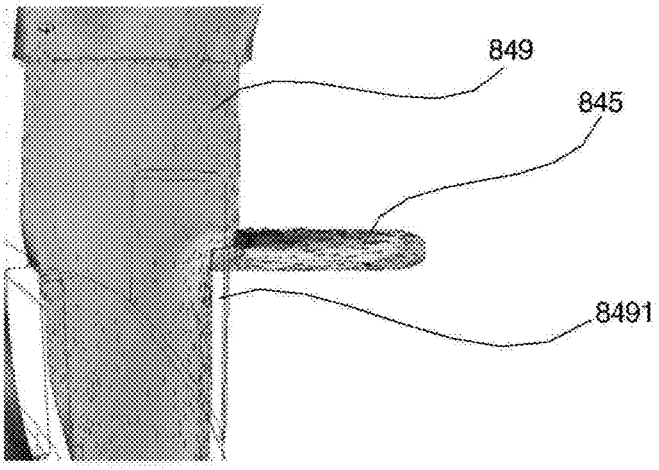

FIG. 4 is a perspective view of a portion of an example pump, FIG. 5 is a cross-sectional view taken along line A-A of FIG. 4, FIG. 6 is a cross-sectional view taken along line B-B in FIG. 4, and FIGS. 7A and 7B illustrate example experimental results of washing water outflow of an example pump.

The cross sectional area of the steam discharge pipe 845 may be smaller than the cross sectional area of the washing water outlet pipe 849. The cross sectional area of the steam discharge pipe 845 may be formed to be smaller than the cross sectional area of the washing water outlet pipe 849 to minimize the loss of washing water into the steam discharge pipe 845.

The steam discharge pipe 845 may be arranged in such a manner that the pipe direction D1 is inclined to the upward direction from the horizontal direction. As shown in FIG. 5, the pipe direction D1 of the steam discharge pipe 845 may have an inclination angle i between the horizontal direction and an acute angle. Since the steam in the housing 82 flows in a direction opposite to the direction of gravity, the pipe direction D1 of the steam discharge pipe 845 may be inclined upward so that the loss of steam from the horizontal washing water outlet pipe 849 having a horizontal pipe direction D2 to the washing water supply unit 7 can be minimized.

The steam discharge pipe 845 may be arranged to be orthogonal to the washing water outlet pipe 849. That is, the steam discharge pipe 845 and the washing water outlet pipe 849 may be arranged in a "T" shape. As shown in FIG. 6, the pipe direction D1 of the steam discharge pipe 845 may be disposed to be perpendicular to the pipe direction D2 of the washing water outlet pipe 849, so that the loss of the washing water to the steam discharge pipe 845 can be minimized and the loss of steam to the washing water supply unit 7 can be minimized.

Referring to FIG. 6, an upstream side cross-sectional area of the washing water outlet pipe 849 may be smaller than a downstream side cross-sectional area based on a portion where the steam discharge pipe 845 is connected. The above-described division between the upstream side and the downstream side may be based on the flow direction of the washing water.

The washing water outlet pipe 849 may include a stepped portion 8491 in which an upstream side, based on the flow direction of the washing water, in a portion where the steam discharge pipe 845 is connected protrudes inward. The stepped portion 8491 may be located at an entrance of the steam discharge pipe 845 based on the steam flow direction. The stepped portion 8491 may allow the washing water flowing in the washing water outlet pipe 849 to pass by the steam discharge pipe 845 without being expelled due to inertia.

FIG. 7A shows a velocity distribution of the washing water when the stepped portion 8491 does not exist, and FIG. 7B shows a velocity distribution of the washing water when the stepped portion 8491 exists. In FIGS. 7A and 7B, the dark regions in the steam discharge pipe 845 indicate a faster washing water speed, and the light regions in the steam discharge pipe 845 indicate a slower washing water speed. Based on the results of the experiment, when the stepped portion 8491 exists, the positive pressure of the steam discharge pipe 845 may be reduced, and the loss of the washing water to the steam discharge pipe 845 may be minimized.

Figure 8:
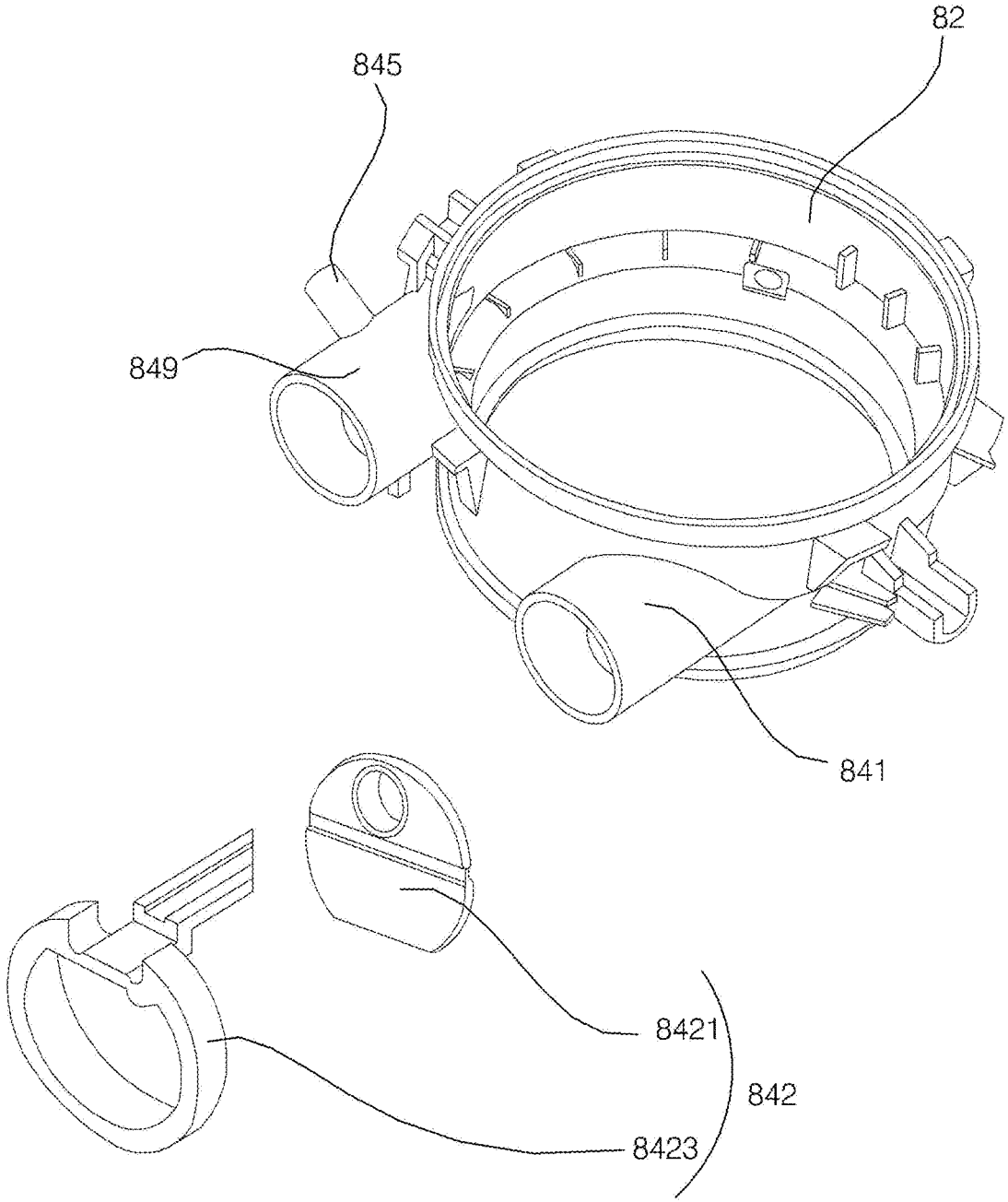
FIG. 8 is a partial exploded perspective view showing an example pump.
Figure 9:
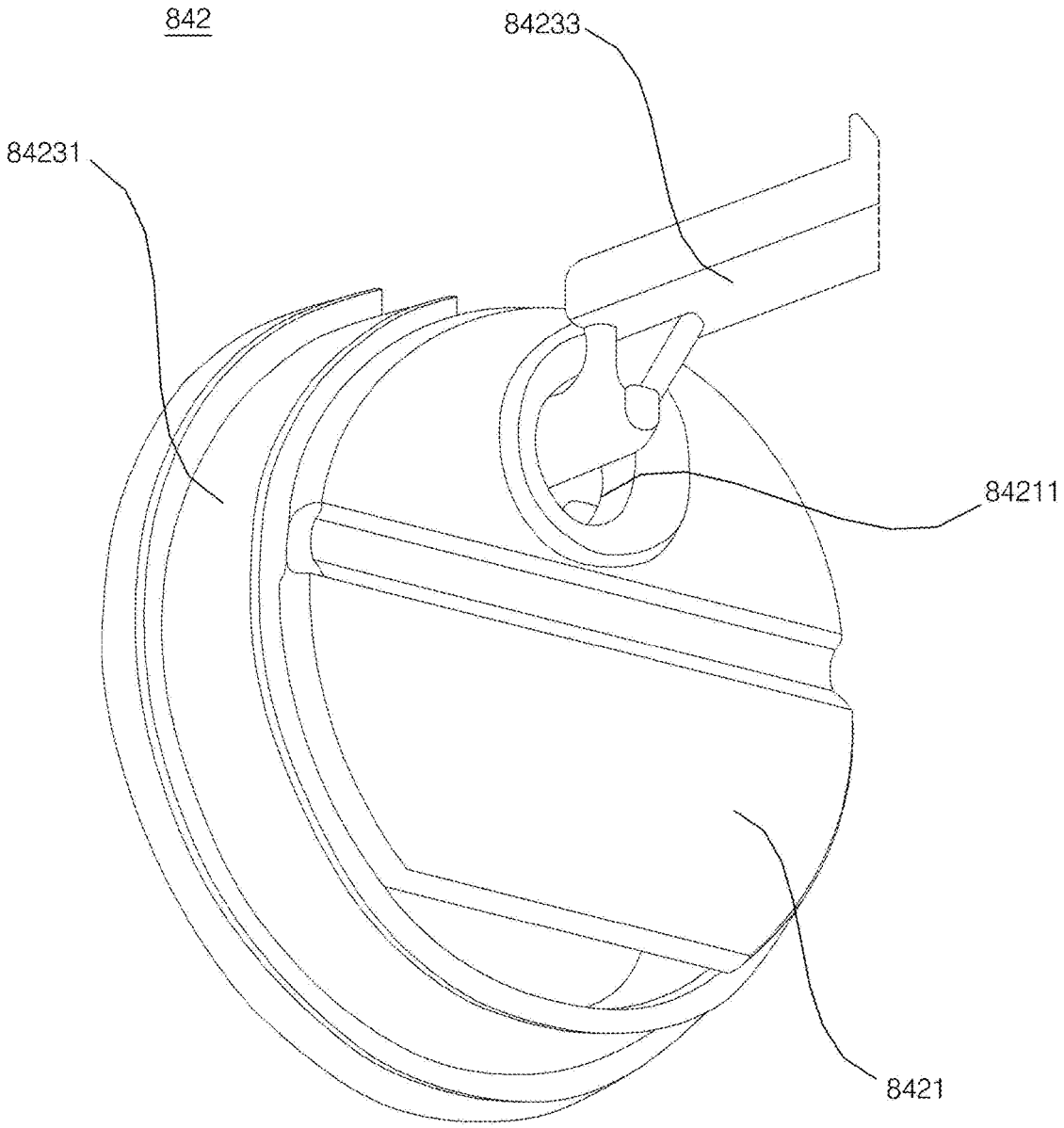
FIG. 9 is a perspective view showing an example check valve of an example pump.
Figure 10:
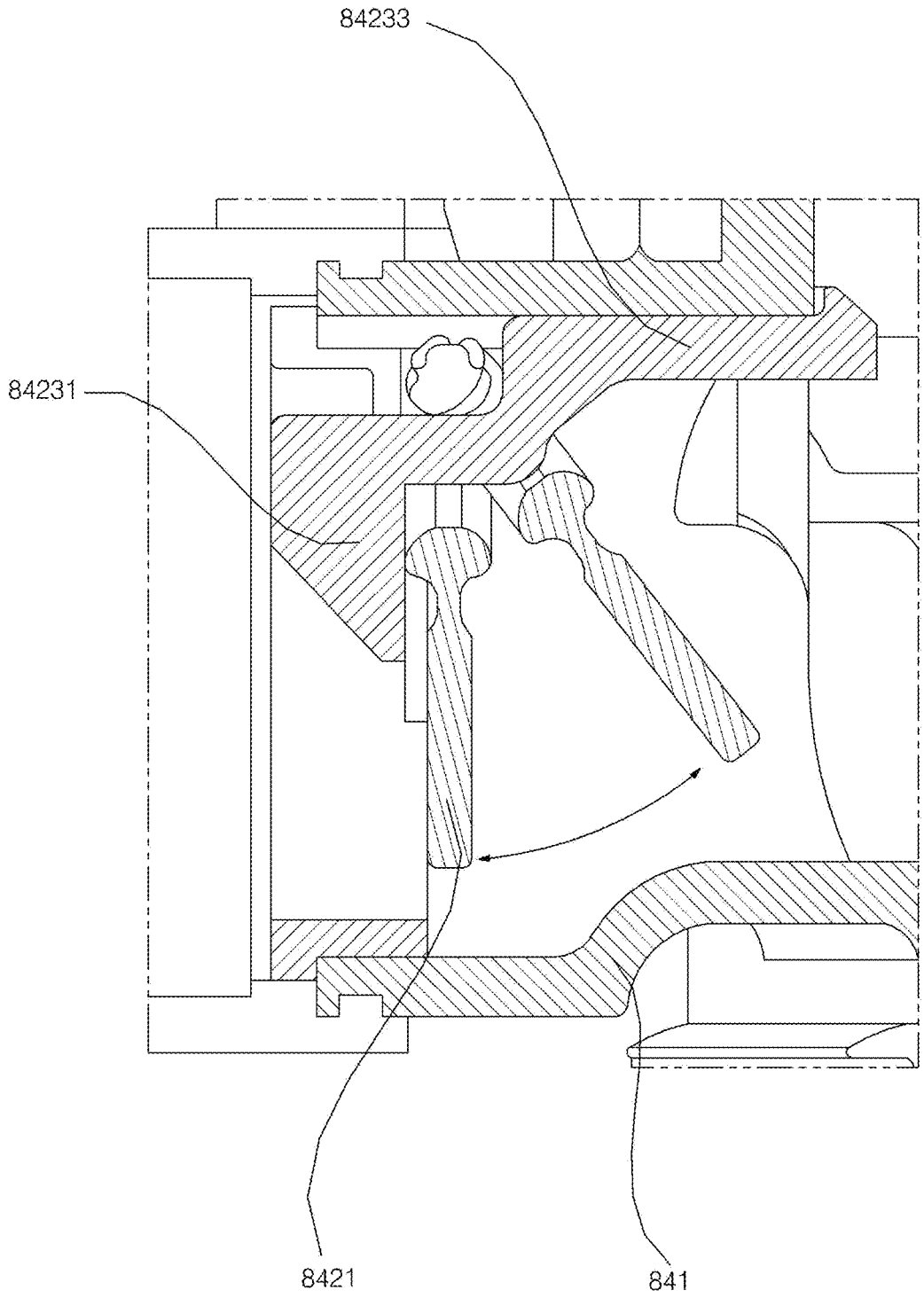
FIG. 10 is an operational example of an example check valve of an example pump.

FIG. 8 is a partial exploded perspective view of an example pump, FIG. 9 is a perspective view of an example check valve of an example pump, and FIG. 10 is an operational example of an example check valve of an example pump.

The check valve 842 may open and close the washing water inlet pipe 841 so that the steam which is generated inside the housing 82 by the heater 81 may not flow out through the washing water inlet pipe 841. The check valve 842 may be opened when the impeller 85 rotates and may be closed when the impeller 85 stops. That is, the check valve 842 may be opened when the washing water flows and may be closed when the washing water does not flow. The check valve 842 may close the washing water inlet pipe 841 during the steam generation of the heater 81 so that the steam generated inside the housing 82 may not flow out to the supply pipe 131 through the washing water inlet pipe 841 from the negative pressure chamber C1.

The check valve 842 may include a valve body 8421 having a circular segment shape, and a valve fixture 8423, which is coupled so that the valve body 8421 can be rotatable.

The valve body 8421 may be rotated to open and close the washing water inlet pipe 841. The valve body 8421 may rotate toward the negative pressure chamber C1 side when opened. The valve body 8421 may be provided with a valve hole 84211 through which a part of the valve fixture 8423 is passed.

The valve body 8421 may be formed in a circular segment shape so as not to completely block the washing water inlet pipe 841. The valve body 8421 may be formed in a circular shape having a cut lower portion so that a part of the lower portion of the washing water inlet pipe 841 is opened when closed. In some cases where the washing water in the pump 8 should be drained, the drain pump 139 may operate to drain water from the pump 8. For example, when the drain pump 139 operates, the washing water in the pump 8 may flow into the supply pipe 131 through a gap between the valve body 8421 and the washing water inlet pipe 841 and may be discharged to the outside through the sump 13 and the drainage pipe 137.

The valve fixture 8423 may be coupled so that the valve body 8421 can rotate. The valve fixture 8423 may be coupled to the washing water inlet pipe 841 so that the valve body 8421 can be arranged to be rotatable for the washing water inlet pipe 841. The valve fixture 8423 may be provided with a ring-shaped outlet end connecting unit 84231 and a hinge unit 84233 penetrating the valve hole 84211.

The outlet end connecting unit 84231 may be formed in a ring shape and may be coupled to a distal end of the washing water inlet pipe 841. The circumference of the outlet end connecting unit 84231 may be in contact with the valve body 8421. The hinge unit 84233 may pass through the valve hole 84211 and may be coupled to the washing water inlet pipe 841.

When the washing water is introduced through the supply pipe 131 during rotation of the impeller 85, the valve body 8421 may be rotated by the flow pressure of the washing water to open the washing water inlet pipe 841. When the impeller 85 is stopped, the valve body 8421 may be in contact with the outlet end connecting unit 84231 to close the washing water inlet pipe 841.

Example operations of the pump and the dishwasher will be described as follows.

When the water supply valve 136 is opened, washing water may be supplied from an external water supply source through the water supply channel 135 and be stored in the sump 13. When the motor 87 rotates the impeller 85, the washing water stored in the sump 13 may flow into the washing water inlet pipe 841 through the supply pipe 131. At this time, the check valve 842 may be rotated by the flow pressure of the washing water to open the washing water inlet pipe 841. The washing water flowed into the washing water inlet pipe 841 may flow into the negative pressure chamber C1 inside the housing 82. The washing water in the negative pressure chamber C1 may flow into the positive pressure chamber C2 through the communication hole 86 and then flow into the washing water outlet pipe 849 by the rotation of the impeller 85. At this time, the heater 81 may heat the washing water flowed into the housing 82. The washing water flowed into the washing water outlet pipe 849 may partially flow to the steam discharge pipe 845 but mostly may flow to the washing water supply unit 7. The washing water flowed into the washing water supply unit 7 may be sprayed through the upper spraying arm 3 and/or the lower spraying arm 5 depending on the operation of the switching valve 75. The washing water sprayed through the upper spraying arm 3 and/or the lower spraying arm 5 may be recovered to the sump 13.

In some implementations, when the heater 81 operates but the motor 87 does not rotate the impeller 85, the washing water in the housing 82 may be heated to generate steam. The steam generated in the housing 82 may flow into the washing water outlet pipe 849 and then flow to the steam discharge pipe 845. The steam flowing in the washing water outlet pipe 849 can be partially flow to the washing water supply unit 7 but mostly flow to the steam discharge pipe 845.

The steam flowed into the steam discharge pipe 845 may be discharged into the tub 11 through the steam supply unit 6.

According to the pump of the present disclosure and the dishwasher including the same, one or more of the following effects can be obtained.

For example, the steam discharge pipe coupled to the positive pressure chamber of the pump may prevent air in the tub from flowing into the pump, thereby securing the flow rate of the pump.

In some implementations, the steam discharge pipe coupled to the washing water outlet pipe may minimize flow of steam generated in the pump to the spraying arm side, thereby improving the steam performance.

In some implementations where the steam discharge pipe is coupled to the washing water outlet pipe, the pump performance may be improved by minimizing discharge of washing water to the steam discharge pipe.

In some implementations, steam generated in the pump is restricted from flowing out to the sump side by the check valve disposed in the washing water inlet pipe, thereby improving the steam performance.

Hereinabove, although the present disclosure has been described with reference to exemplary implementations and the accompanying drawings, the present disclosure is not limited thereto, but may be variously modified and altered by those skilled in the art to which the present disclosure pertains without departing from the spirit and scope of the present disclosure claimed in the following claims.

What is claimed is:

1. A dishwasher comprising:

a tub;

a spray arm configured to spray washing water into the tub;

a steam supplier configured to discharge steam into the tub;

a sump configured to store washing water; and a pump that is configured to supply washing water stored in the sump to the spray arm, that is configured to generate steam, and that is configured to supply steam to the steam supplier, the pump comprising:

a housing configured to receive washing water from the sump, a heater disposed below the housing and configured to heat washing water in the housing, the heater being configured to generate steam based on heating washing water in the housing, a partition wall that divides an inside space of the housing into an upper portion and a lower portion, the partition wall defining a communication hole that enables fluid communication between the upper portion and the lower portion of the housing, an impeller disposed in the upper portion of the housing, and a water outlet pipe that protrudes from the upper portion of the housing, that communicates with the housing, and that is configured to discharge washing water from the housing, wherein the water outlet pipe defines a steam discharge hole at a position above a horizontal axis passing through a circumferential surface of the water outlet pipe, and wherein a center axis of the steam discharge hole defines an acute angle with respect to the horizontal axis.

2. The dishwasher of claim 1, wherein the pump further comprises a steam discharge pipe that is located at the steam discharge hole, that protrudes from the circumferential surface of the water outlet pipe, and that is configured to carry steam discharged through the steam discharge hole.

3. The dishwasher of claim 1, wherein the steam discharge hole is spaced apart from the housing.

4. The dishwasher of claim 1, wherein the water outlet pipe protrudes from a circumferential surface of the housing, and wherein the pump further comprises a water inlet pipe that protrudes from the circumferential surface of the housing, that is coupled to the lower portion of the housing, and that is configured to provide washing water to the housing.

5. The dishwasher of claim 4, wherein the water outlet pipe and the water inlet pipe extend parallel to each other, and are disposed at a first side of the housing with respect to a rotational axis of the impeller.

6. The dishwasher of claim 1, wherein the water outlet pipe includes a stepped portion that protrudes from an inner surface of the water outlet pipe and that faces the steam discharge hole.

7. The dishwasher of claim 6, wherein the stepped portion is located at one side of the steam discharge hole.

8. The dishwasher of claim 6, wherein the stepped portion is located at an upstream side relative to the steam discharge hole, the upstream side facing the housing.

9. The dishwasher of claim 8, wherein a diameter of the water outlet pipe at the upstream side is less than a diameter of the water outlet pipe at a downstream side relative to the steam discharge hole.

10. The dishwasher of claim 1, wherein a cross-sectional area of the steam discharge hole is less than a cross-sectional area of the water outlet pipe.

11. The dishwasher of claim 1, wherein the center axis of the steam discharge hole is orthogonal to a longitudinal axis extending along the water outlet pipe.

12. The dishwasher of claim 1, wherein the pump further comprises a steam discharge pipe that protrudes from the circumferential surface of the water outlet pipe and that extends along the center axis of the steam discharge hole, the steam discharge pipe being configured to carry steam discharged through the steam discharge hole.

13. The dishwasher of claim 1, wherein the pump further comprises a steam discharge pipe that is connected to the circumferential surface of the water outlet pipe and that extends upward from the steam discharge hole.

14. A dishwasher comprising:

a tub;

a spray arm configured to spray washing water into the tub;

a steam supplier configured to discharge steam into the tub;

a sump configured to store washing water; and a pump that is configured to supply washing water stored in the sump to the spray arm, that is configured to generate steam, and that is configured to supply steam to the steam supplier, the pump comprising:

a housing configured to receive washing water from the sump, a heater configured to heat washing water in the housing and to generate steam based on heating washing water in the housing, an impeller disposed in the housing, and a water outlet pipe that protrudes from the housing, that communicates with the housing, and that is configured to discharge washing water from the housing, wherein the water outlet pipe defines a steam discharge hole at an upward facing circumferential surface of the water outlet pipe, the steam discharge hole being configured to transmit steam generated by the pump to the steam supplier, wherein the water outlet pipe comprises:

a coupling region that defines the steam discharge hole, a first portion that extends from the coupling region toward the housing, and a second portion that extends from the coupling region in a direction away from the housing, and wherein a cross-sectional area of the first portion is less than a cross-sectional area of the second portion.

15. The dishwasher of claim 14, wherein the water outlet pipe further comprises a stepped portion that protrudes from an inner surface of the water outlet pipe and that is disposed at the first portion of the water outlet pipe.

16. The dishwasher of claim 14, wherein a thickness of the first portion of the water outlet pipe is greater than a thickness of the second portion of the water outlet pipe.

17. The dishwasher of claim 14, wherein the first portion of the water outlet pipe is located at an upstream side relative to the coupling region, and wherein the second portion of the water outlet pipe is located at a downstream side relative to the coupling region.

18. A dishwasher comprising:

a tub;

a spray arm configured to spray washing water into the tub;

a steam supplier configured to discharge steam into the tub;

a sump configured to store washing water; and a pump that is configured to supply washing water stored in the sump to the spray arm, that is configured to generate steam, and that is configured to supply steam to the steam supplier, the pump comprising:

a housing configured to receive washing water from the sump, a heater configured to heat washing water in the housing and to generate steam based on heating washing water in the housing, an impeller disposed in the housing, and a water outlet pipe that protrudes from the housing, that communicates with the housing, and that is configured to discharge washing water from the housing, wherein the water outlet pipe defines a steam discharge hole at an upward facing circumferential surface of the water outlet pipe, the steam discharge hole being configured to transmit steam generated by the pump to the steam supplier, wherein the steam discharge hole is defined at a position above a horizontal axis passing through the circumferential surface of the water outlet pipe, and wherein a center axis of the steam discharge hole defines an acute angle with respect to the horizontal axis.

* * * * *